US010931005B2

(12) United States Patent
Shriner et al.

(10) Patent No.: US 10,931,005 B2
(45) Date of Patent: Feb. 23, 2021

(54) HEARING DEVICE INCORPORATING A PRIMARY ANTENNA IN CONJUNCTION WITH A CHIP ANTENNA

(71) Applicant: Starkey Laboratories, Inc., Eden Prairie, MN (US)

(72) Inventors: Paul Shriner, Hopkins, MN (US); Dong Xue, Bloomington, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 6 days.

(21) Appl. No.: 16/173,836

(22) Filed: Oct. 29, 2018

(65) Prior Publication Data

US 2020/0136241 A1 Apr. 30, 2020

(51) Int. Cl.

| | |
|---|---|
| ***H01Q 1/27*** | (2006.01) |
| ***H01Q 1/38*** | (2006.01) |
| ***H01Q 9/04*** | (2006.01) |
| ***H04R 1/02*** | (2006.01) |
| ***H04R 1/10*** | (2006.01) |
| ***H04R 1/32*** | (2006.01) |
| ***H04R 25/00*** | (2006.01) |

(52) U.S. Cl.

CPC ..... *H01Q 1/38* (2013.01); *H01Q 9/0407* (2013.01); *H04R 1/025* (2013.01); *H04R 1/1016* (2013.01); *H04R 1/323* (2013.01); *H04R 25/554* (2013.01); *H04R 25/658* (2013.01); *H04R 2225/51* (2013.01)

(58) Field of Classification Search

CPC ..... H04R 1/10; H04R 2225/51; H04R 25/55; H04R 25/00; H01Q 1/22–1/243; H01Q 1/273

See application file for complete search history.

(56) References Cited

U.S. PATENT DOCUMENTS

| | | | |
|---|---|---|---|
| 5,394,159 | A | 2/1995 | Schneider et al. |
| 6,429,819 | B1 | 8/2002 | Bishop et al. |
| 6,762,729 | B2 | 7/2004 | Egashira |

(Continued)

FOREIGN PATENT DOCUMENTS

| | | |
|---|---|---|
| EP | 3316598 A1 | 5/2008 |
| EP | 2680613 | 1/2014 |

(Continued)

OTHER PUBLICATIONS

IEEE Std 145-1983, "IEEE Standard Definitions of Terms for Antennas", Jun. 22, 1983, 31 pp.

(Continued)

*Primary Examiner* — Hasan Z Islam

(74) *Attorney, Agent, or Firm* — Shumaker & Sieffert, P.A.

(57) ABSTRACT

An ear-worn electronic device is adapted to be worn at, by, in or on an ear of a wearer. The device comprises a housing configured to be supported at, by, in or on the wearer's ear. A processor is disposed in the housing. A speaker or a receiver is coupled to the processor. A radio frequency transceiver is disposed in the housing and coupled to the processor. An antenna arrangement is disposed in or on the housing and coupled to the transceiver. The antenna arrangement comprises a primary antenna and a chip antenna connected to the primary antenna. The primary antenna serves as a counterpoise for the chip antenna and feeds the chip antenna.

16 Claims, 8 Drawing Sheets

(56) References Cited

U.S. PATENT DOCUMENTS

| | | | | |
|---|---|---|---|---|
| 6,762,730 | B2 | 7/2004 | Schadler | |
| 6,768,468 | B2 | 7/2004 | Crouch et al. | |
| 7,016,738 | B1 | 3/2006 | Karunasiri | |
| 7,079,079 | B2 * | 7/2006 | Jo | H01Q 1/243 343/700 MS |
| 7,095,372 | B2 | 8/2006 | Soler Castany et al. | |
| 7,148,850 | B2 | 12/2006 | Puente Baliarda et al. | |
| 7,202,822 | B2 | 4/2007 | Baliarda et al. | |
| 7,342,545 | B2 | 3/2008 | Huynh et al. | |
| 7,751,902 | B1 | 7/2010 | Karunasiri | |
| 8,259,026 | B2 | 9/2012 | Pulimi et al. | |
| 8,405,561 | B2 | 3/2013 | Handy et al. | |
| 8,406,831 | B2 | 3/2013 | Yang et al. | |
| 8,565,457 | B2 | 10/2013 | Polinske et al. | |
| 8,724,835 | B2 | 5/2014 | Kerselaers et al. | |
| 9,300,367 | B2 | 3/2016 | Christensen et al. | |
| 9,374,650 | B2 | 6/2016 | Bauman | |
| 9,432,779 | B2 | 8/2016 | Kerselaers | |
| 9,484,631 | B1 | 11/2016 | Napoles et al. | |
| 9,635,475 | B2 | 4/2017 | Polinkse et al. | |
| 9,641,944 | B2 | 5/2017 | Johnson et al. | |
| 9,706,318 | B2 | 7/2017 | So et al. | |
| 9,906,879 | B2 | 2/2018 | Prchal et al. | |
| 9,980,065 | B2 | 5/2018 | Higgins et al. | |
| 10,070,232 | B2 | 9/2018 | So et al. | |
| 2005/0099341 | A1 | 5/2005 | Zhang et al. | |
| 2005/0117765 | A1 | 6/2005 | Meyer et al. | |
| 2005/0195112 | A1 | 9/2005 | Baliarda et al. | |
| 2006/0093172 | A1 | 5/2006 | Ludvigsen et al. | |
| 2006/0220966 | A1 | 10/2006 | Sarychev et al. | |
| 2006/0239483 | A1 | 10/2006 | Orts et al. | |
| 2008/0267436 | A1 | 10/2008 | Kerselaers et al. | |
| 2008/0278405 | A1 | 11/2008 | Montgomery et al. | |
| 2008/0287084 | A1 | 11/2008 | Krebs et al. | |
| 2009/0219214 | A1 | 9/2009 | Oh et al. | |
| 2009/0231211 | A1 | 9/2009 | Zweers | |
| 2010/0026775 | A1 | 2/2010 | Parsi et al. | |
| 2011/0022121 | A1 * | 1/2011 | Meskins | A61N 1/37229 607/57 |
| 2011/0030751 | A1 | 2/2011 | Wu | |
| 2011/0050522 | A1 * | 3/2011 | Kuo | H01Q 1/244 343/728 |
| 2013/0257676 | A1 | 10/2013 | Kerselaers et al. | |
| 2013/0343586 | A1 | 12/2013 | Kvist et al. | |
| 2014/0091974 | A1 | 4/2014 | Desclos et al. | |
| 2014/0239427 | A1 | 8/2014 | Huang et al. | |
| 2014/0376735 | A1 | 12/2014 | Asrani et al. | |
| 2015/0042524 | A1 | 2/2015 | Kerselaers et al. | |
| 2015/0049891 | A1 | 2/2015 | Johnson et al. | |
| 2015/0116153 | A1 | 4/2015 | Chen et al. | |
| 2015/0118973 | A1 | 4/2015 | Montgomery et al. | |
| 2016/0050502 | A1 * | 2/2016 | Kvist | H04R 25/556 381/315 |
| 2016/0141757 | A1 | 5/2016 | Lai et al. | |
| 2016/0295335 | A1 | 10/2016 | Vajha et al. | |
| 2016/0330552 | A1 | 11/2016 | Flood | |
| 2016/0366525 | A1 | 12/2016 | Bodvarsson | |
| 2016/0381471 | A1 | 12/2016 | Henriksen et al. | |
| 2017/0150278 | A1 * | 5/2017 | Ruaro | H04R 25/552 |
| 2017/0156011 | A1 * | 6/2017 | Rasmussen | H05K 1/028 |
| 2017/0358867 | A1 | 12/2017 | Akahori | |
| 2018/0027343 | A1 | 1/2018 | Dobson et al. | |
| 2018/0069322 | A1 | 3/2018 | Vouvakis et al. | |
| 2018/0084351 | A1 | 3/2018 | Polinske et al. | |
| 2018/0115055 | A1 | 4/2018 | Hosadurga et al. | |
| 2018/0124528 | A1 | 5/2018 | Polinske et al. | |
| 2019/0098420 | A1 | 3/2019 | Elgahannai et al. | |
| 2019/0116431 | A1 | 4/2019 | Hesselballe et al. | |
| 2019/0116433 | A1 | 4/2019 | Hesselballe et al. | |
| 2019/0116435 | A1 | 4/2019 | Hesselballe et al. | |
| 2019/0261100 | A1 * | 8/2019 | Troelsen | H01Q 1/273 |
| 2020/0186947 | A1 | 6/2020 | Prabhu | |

FOREIGN PATENT DOCUMENTS

| | | | |
|---|---|---|---|
| EP | 2824942 | A1 | 1/2015 |
| EP | 2835862 | A1 | 2/2015 |
| EP | 3313096 | A1 | 4/2018 |

OTHER PUBLICATIONS

Extended Search Report from counterpart European Application No. 19206071.3, dated Feb. 6, 2020, 5 pp.

U.S. Appl. No. 16/000,552, filed Jun. 5, 2018, Elghannai et al.

U.S. Appl. No. 16/057,177, filed Aug. 7, 2018, Shriner.

Berge et al., "Tuning a Dual-Band Bowtie Slot Antenna with Parabolic Radiating Slots for the 900 MHz and 2400 MHz Bands", 6th European Conference on Antennas and Propagation, Mar. 2012, pp. 2376-2379.

Garje et al., "Single-Fee Triangular Slotted Microstrip Bowtie Antenna for Quad-bands Applications", IOSR Journal of Electronics and Communication Engineering, vol. 11, Issue 5, Ver. III, Sep.-Oct. 2016, pp. 22-27.

Mansoul et al., "Multiband reconfigurable Bowtie slot antenna using switchable slot extension for WiFi, WiMAX , and WLAN applications", Microw Opt Technol Lett; 60; 2018 pp. 413-418.

Murata et al., "Broadband Characteristics Analysis of Semicircle-Type Bow-tie Antenna with Hole Slots", Electrical Engineering in Japan, vol. 159, No. 4, 2007, pp. 47-53.

Murugaveni et al., "Design of Slotted Waveguide Antenna for Radar Applications at X-Band", International Journal of Engineering Research & Technology, vol. 3, Issue 11, Nov. 2014, pp. 426-428.

Fractus Antennas User Manual, Nov. 2017, 12 pages.

Response to European Office Action dated May 11, 2020, from counterpart European Application No. 19206071.3, filed Oct. 13, 2020, 12 pages.

* cited by examiner

HEARING DEVICE INCORPORATING A PRIMARY ANTENNA IN CONJUNCTION WITH A CHIP ANTENNA

TECHNICAL FIELD

This application relates generally to hearing devices, including ear-worn electronic devices, hearing aids, personal amplification devices, and other hearables.

BACKGROUND

Hearing devices provide sound for the wearer. Some examples of hearing devices are headsets, hearing aids, speakers, cochlear implants, bone conduction devices, and personal listening devices. For example, hearing aids provide amplification to compensate for hearing loss by transmitting amplified sounds to a wearer's ear canals. Hearing devices may be capable of performing wireless communication with other devices, such as receiving streaming audio from a streaming device via a wireless link. Wireless communication may also be performed for programming the hearing device and transmitting information from the hearing device. For performing such wireless communication, hearing devices such as hearing aids may include a wireless transceiver and an antenna.

SUMMARY

Various embodiments are directed to an ear-worn electronic device adapted to be worn at, by, in or on an ear of a wearer. The device comprises a housing configured to be supported at, by, in or on the wearer's ear. A processor is disposed in the housing. A speaker or a receiver is coupled to the processor. A radio frequency transceiver is disposed in the housing and coupled to the processor. An antenna arrangement is disposed in or on the housing and coupled to the transceiver. The antenna arrangement comprises a primary antenna and a chip antenna connected to the primary antenna. The primary antenna serves as a counterpoise for the chip antenna and feeds the chip antenna.

Various embodiments are directed to a hearing device adapted to be worn at an ear of a wearer. The hearing device comprises a housing configured for insertion at least partially within an ear canal of the wearer's ear. A processor is disposed in the housing. A speaker or a receiver is coupled to the processor. A radio frequency transceiver is disposed in the housing and coupled to the processor. An antenna arrangement is disposed in or on the housing and coupled to the transceiver. The antenna arrangement comprises a planar inverted-F antenna (PIFA antenna) and a chip antenna connected to the PIFA antenna. The PIFA antenna serves as a counterpoise for the chip antenna and feeds the chip antenna.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
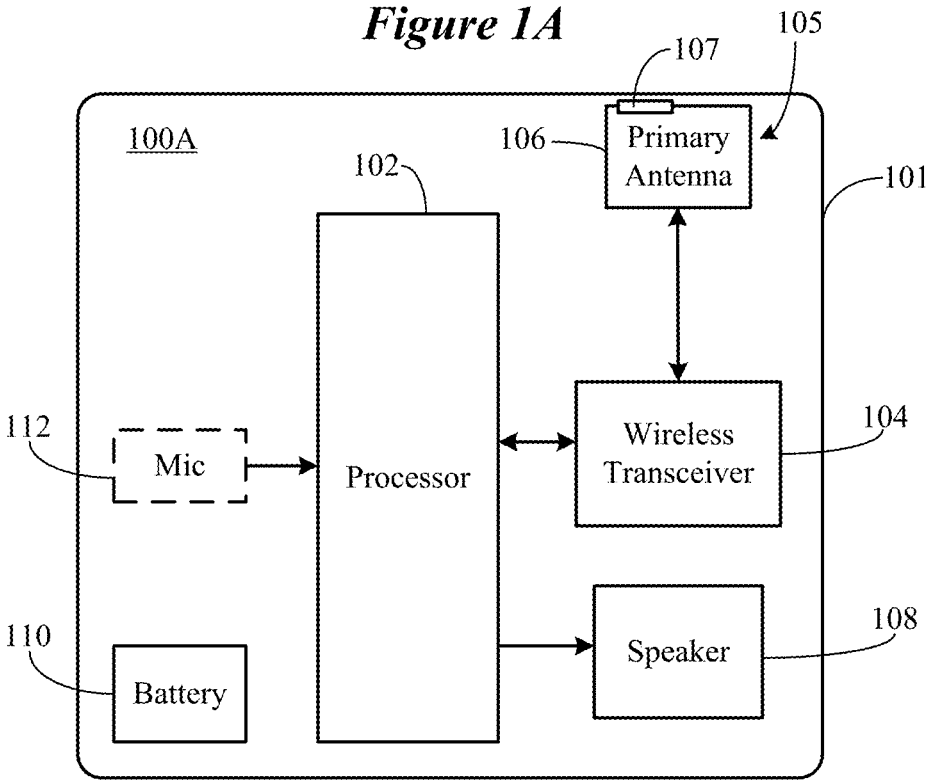
FIGS. 1A and 1B illustrate an ear-worn electronic device arrangement which incorporates an antenna arrangement comprising a primary antenna and one or more chip antennas in accordance with various embodiments.

It is understood that the embodiments described herein may be used with any ear-worn electronic hearing device without departing from the scope of this disclosure. The devices depicted in the figures are intended to demonstrate the subject matter, but not in a limited, exhaustive, or exclusive sense. Ear-worn electronic hearing devices (also referred to herein as "hearing devices"), such as hearables (e.g., wearable earphones, ear monitors, and earbuds), hearing aids, hearing instruments, and hearing assistance devices, typically include an enclosure, such as a housing or shell, within which internal components are disposed. Typical components of a hearing device can include a processor (e.g., a digital signal processor or DSP), memory circuitry, power management circuitry, one or more communication devices (e.g., a radio, a near-field magnetic induction (NFMI) device), one or more antennas, one or more microphones, and a receiver/speaker, for example. Hearing devices can incorporate a long-range communication device, such as a Bluetooth® transceiver or other type of radio frequency (RF) transceiver. A communication device (e.g., a radio or NFMI device) of a hearing device can be configured to facilitate communication between a left ear device and a right ear device of the hearing device.

Hearing devices of the present disclosure can incorporate an antenna coupled to a high-frequency transceiver, such as a 2.4 GHz radio. The RF transceiver can conform to an IEEE 802.11 (e.g., WiFi®) or Bluetooth® (e.g., BLE, Bluetooth® 4. 2 or 5.0) specification, for example. It is understood that hearing devices of the present disclosure can employ other transceivers or radios, such as a 900 MHz radio. Hearing devices of the present disclosure can be configured to receive streaming audio (e.g., digital audio data or files) from an electronic or digital source. Representative electronic/digital sources (e.g., accessory devices) include an assistive listening system, a TV streamer, a radio, a smartphone, a laptop, a cell phone/entertainment device (CPED) or other electronic device that serves as a source of digital audio data or other types of data files. Hearing devices of the present disclosure can be configured to effect bi-directional communication (e.g., wireless communication) of data with an external source, such as a remote server via the Internet or other communication infrastructure. Hearing devices that include a left ear device and a right ear device can be configured to effect bi-directional communication (e.g., wireless communication) therebetween, so as to implement ear-to-ear communication between the left and right ear devices.

The term hearing device of the present disclosure refers to a wide variety of ear-level electronic devices that can aid a person with impaired hearing. The term hearing device also refers to a wide variety of devices that can produce processed sound for persons with normal hearing. Hearing devices of the present disclosure include hearables (e.g., wearable earphones, headphones, earbuds, virtual reality headsets), hearing aids (e.g., hearing instruments), cochlear implants, and bone-conduction devices, for example. Hearing devices include, but are not limited to, behind-the-ear (BTE), in-the-ear (ITE), in-the-canal (ITC), invisible-in-canal (IIC), receiver-in-canal (RIC), receiver-in-the-ear (RITE) or completely-in-the-canal (CIC) type hearing devices or some combination of the above. Throughout this disclosure, reference is made to a "hearing device," which is understood to refer to a system comprising a single left ear device, a single right ear device, or a combination of a left ear device and a right ear device.

Figure 1B:
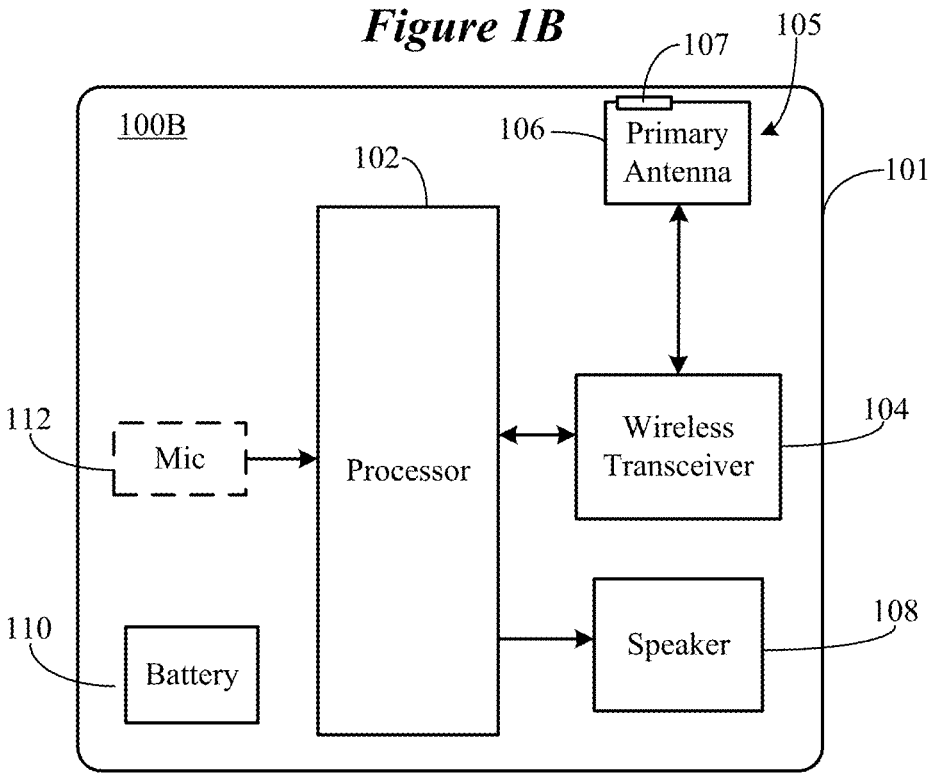

FIGS. 1A and 1B illustrate various components of a representative hearing device arrangement in accordance with various embodiments. FIGS. 1A and 1B illustrate first and second hearing devices 100A and 100B configured to be supported at, by, in or on left and right ears of a wearer. In some embodiments, a single hearing device 100A or 100B can be supported at, by, in or on the left or right ear of a wearer. As illustrated, the first and second hearing devices 100A and 100B include the same functional components. It is understood that the first and second hearing devices 100A and 100B can include different functional components. The first and second hearing devices 100A and 100B can be representative of any of the hearing devices disclosed herein.

The first and second hearing devices 100A and 100B include an enclosure 101 configured for placement, for example, over or on the ear, entirely or partially within the external ear canal (e.g., between the pinna and ear drum) or behind the ear. Disposed within the enclosure 101 is a processor 102 which incorporates or is coupled to memory circuitry. The processor 102 can include or be implemented as a multi-core processor, a digital signal processor (DSP), an audio processor or a combination of these processors. For example, the processor 102 may be implemented in a variety of different ways, such as with a mixture of discrete analog and digital components that include a processor configured to execute programmed instructions contained in a processor-readable storage medium (e.g., solid-state memory, e.g., Flash).

The processor 102 is coupled to a wireless transceiver 104 (also referred to herein as a radio), such as a BLE transceiver. The wireless transceiver 104 is operably coupled to an antenna arrangement 105 configured for transmitting and receiving radio signals. The antenna arrangement 105, according to various embodiments, includes a primary antenna 106 and at least one chip antenna 107 connected to the primary antenna 106. In some embodiments, a single chip antenna 107 is connected to the primary antenna 106. In other embodiments, two or more chip antennas 107 are connected to the primary antenna 106. The primary antenna 106 can be any type of antenna suitable for incorporation in the first and second hearing devices 100A and 100B, several representative examples of which are described hereinbelow. The chip antenna 107 can be any type of chip antenna suitable for use in conjunction with the primary antenna 106, several representative examples of which are described hereinbelow.

The wireless transceiver 104 and antenna arrangement 105 can be configured to enable ear-to-ear communication between the two hearing devices 100A and 100B, as well as communications with an external device (e.g., a smartphone or a digital music player). A battery 110 or other power source (rechargeable or conventional) is provided within the enclosure 101 and is configured to provide power to the various components of the hearing devices 100A and 100B. A speaker or receiver 108 is coupled to an amplifier (not shown) and the processor 102. The speaker or receiver 108 is configured to generate sound which is communicated to the wearer's ear.

In some embodiments, the hearing devices 100A and 100B include a microphone 112 mounted on or inside the enclosure 101. The microphone 112 may be a single microphone or multiple microphones, such as a microphone array. The microphone 112 can be coupled to a preamplifier (not shown), the output of which is coupled to the processor 102. The microphone 112 receives sound waves from the environment and converts the sound into an input signal. The input signal is amplified by the preamplifier and sampled and digitized by an analog-to-digital converter of the processor 102, resulting in a digitized input signal. In some embodiments (e.g., hearing aids), the processor 102 (e.g., DSP circuitry) is configured to process the digitized input signal into an output signal in a manner that compensates for the wearer's hearing loss. When receiving an audio signal from an external source, the wireless transceiver 104 may produce a second input signal for the DSP circuitry of the processor 102 that may be combined with the input signal produced by the microphone 112 or used in place thereof In other embodiments, (e.g., hearables), the processor 102 can be configured to process the digitized input signal into an output signal in a manner that is tailored or optimized for the wearer (e.g., based on wearer preferences). The output signal is then passed to an audio output stage that drives the speaker or receiver 108, which converts the output signal into an audio output.

Some embodiments are directed to a custom hearing aid, such as an ITC, CIC, or IIC hearing aid, for example. For example, some embodiments are directed to a custom hearing aid which includes a wireless transceiver and an antenna arrangement configured to operate in the 2.4 GHz ISM frequency band (referred to as the "Bluetooth® band" herein). Creating a robust antenna arrangement for a 2.4 GHz custom hearing aid represents a significant engineering challenge. A custom hearing aid is severely limited in space, and the antenna arrangement is in close proximity to other electrical components, both of which impacts antenna performance. Because the human body is very lossy and a custom hearing aid is positioned within the ear canal, a high performance antenna arrangement is particularly desirable.

Figure 2A:
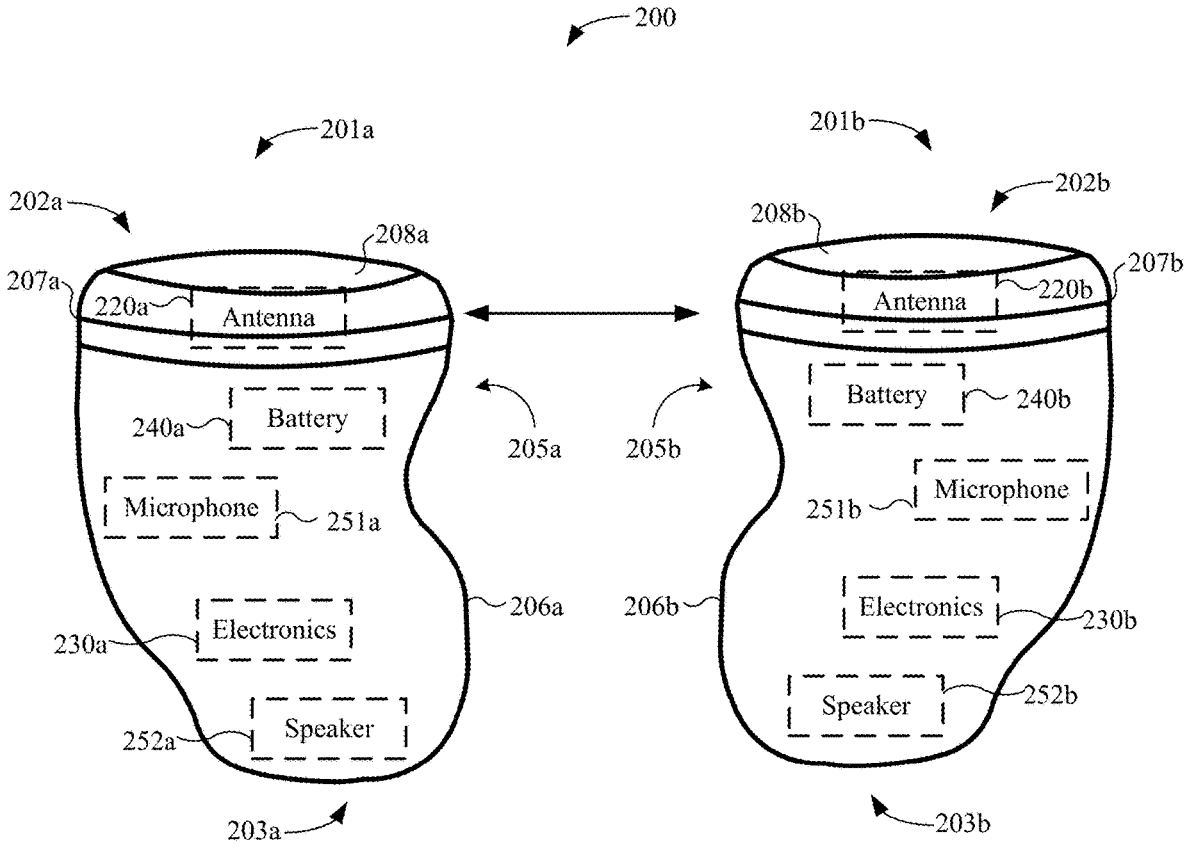
FIGS. 2A and 2B illustrate a custom hearing aid system which incorporates an antenna arrangement comprising a primary antenna and at least one chip antenna in accordance with various embodiments.
Figure 2B:
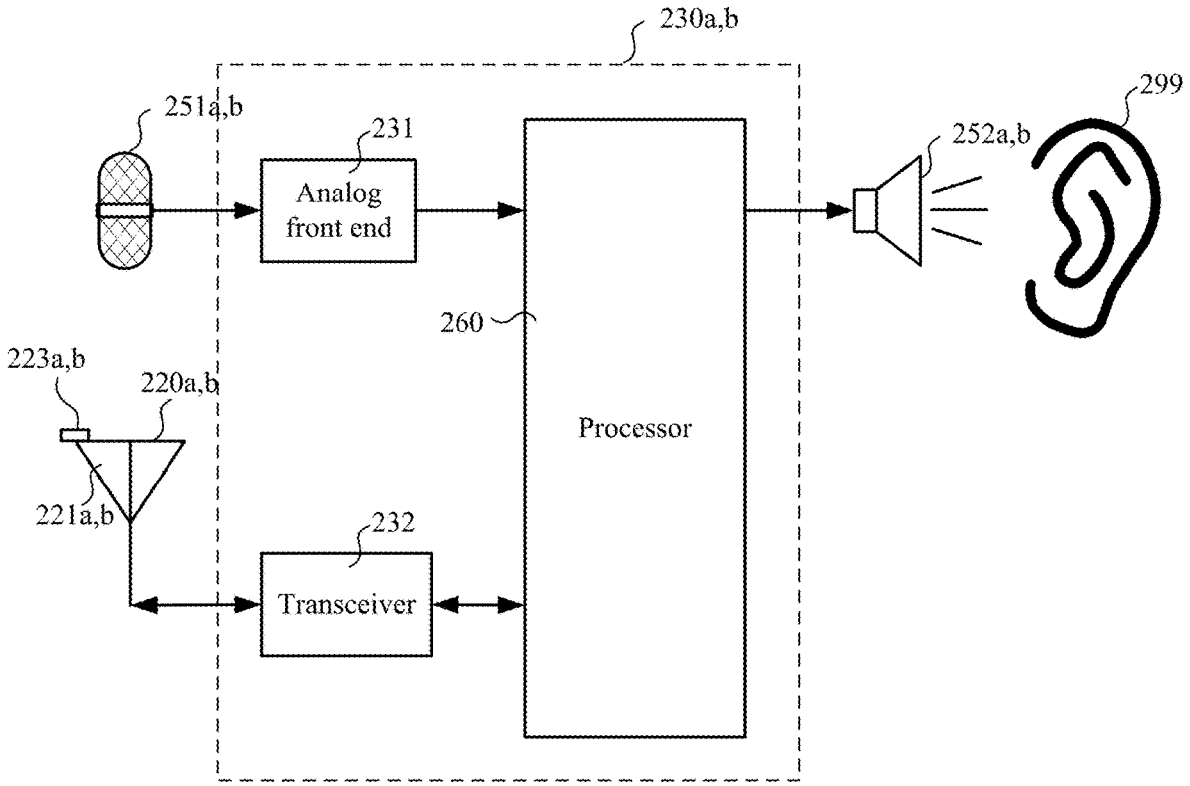

FIGS. 2A and 2B illustrate a custom hearing aid system which incorporates a high performance antenna arrangement in accordance with various embodiments. The hearing aid system 200 shown in FIGS. 2A and 2B includes two hearing devices, e.g., left 201*a* and right 201*b* side hearing devices, configured to wirelessly communicate with each other and external devices and systems. FIG. 2A conceptually illustrates functional blocks of the hearing devices 201*a*, 201*b*. The position of the functional blocks in FIG. 2A does not necessarily indicate actual locations of components that implement these functional blocks within the hearing devices 201*a*, 201*b*. FIG. 2B is a block diagram of components that may be disposed at least partially within the enclosure 205*a*, 205*b* of the hearing device 201*a*, 201*b*.

Each hearing device 201*a*, 201*b* includes a physical enclosure 205*a*, 205*b* that encloses an internal volume. The enclosure 205*a*, 205*b* is configured for at least partial insertion within the wearer's ear canal. The enclosure 205*a*, 205*b* includes an external side 202*a*, 202*b* that faces away from the wearer and an internal side 203*a*, 203*b* that is inserted in the ear canal. The enclosure 205*a*, 205*b* comprises a shell 206*a*, 206*b* and a faceplate 207*a*, 207*b*. The faceplate 207*a*, 207*b* may include a battery door 208*a*, 208*b* or drawer disposed near the external side 202*a*, 202*b* of the enclosure 205*a*, 205*b* and configured to allow the battery 240*a*, 240*b* to be inserted and removed from the enclosure 205*a*, 205*b*.

An antenna arrangement 220*a*, 220*b* includes a primary antenna 221*a,b* in conjunction with at least one chip antenna 223*a,b*, various configurations of which are illustrated and described herein. The antenna arrangement 220*a,b* can include a matching circuit that compensates for a smaller size antenna which allows the antenna arrangement 220*a,b* to fit within a customized device, such as a device that fits partially or fully within the ear canal of the wearer. The matching circuit can be designed so that the power transfer from the transceiver 232 to the antenna arrangement 220*a,b*, provides a specified antenna efficiency, e.g., an optimal antenna efficiency for the customized environment.

The battery 240*a*, 240*b* powers electronic circuitry 230*a*, 230*b* which is also disposed within the shell 206*a*, 206*b*. As illustrated in FIGS. 2A and 2B, the hearing device 201*a*, 201*b* may include one or more microphones 251*a*, 251*b* configured to pick up acoustic signals and to transduce the acoustic signals into microphone electrical signals. The electrical signals generated by the microphones 251*a*, 251*b* may be conditioned by an analog front end 231 (see FIG. 2B) by filtering, amplifying and/or converting the microphone electrical signals from analog to digital signals so that the digital signals can be further processed and/or analyzed by the processor 260. The processor 260 may perform signal processing and/or control various tasks of the hearing device 201*a*, 201*b*. In some implementations, the processor 260 comprises a DSP that may include additional computational processing units operating in a multi-core architecture.

The processor 260 is configured to control wireless communication between the hearing devices 201*a*, 201*b* and/or an external accessory device (e.g., a smartphone, a digital music player) via the antenna arrangement 220*a*, 220*b*. The wireless communication may include, for example, audio streaming data and/or control signals. The electronic circuitry 230*a*, 230*b* of the hearing device 201*a*, 201*b* includes a transceiver 232. The transceiver 232 has a receiver portion that receives communication signals from the antenna arrangement 220*a*, 220*b*, demodulates the communication signals, and transfers the signals to the processor 260 for further processing. The transceiver 232 also includes a transmitter portion that modulates output signals from the processor 260 for transmission via the antenna arrangement 220*a*, 220*b*. Electrical signals from the microphone 251*a*, 251*b* and/or wireless communication received via the antenna 220*a*, 220*b* may be processed by the processor 260 and converted to acoustic signals played to the wearer's ear 299 via a speaker 252*a*, 252*b*.

Embodiments of the disclosure are directed to an ear-worn electronic device which incorporates an antenna arrangement comprising a primary antenna in conjunction with at least one chip antenna. The antenna arrangement is connected to a wireless transceiver of the ear-worn electronic device. According to some aspects, the chip antenna is connected to the primary antenna such that the wireless transceiver is configured to concurrently excite the primary antenna and the chip antenna. In other aspects, the primary and chip antennas are configured to cooperate concurrently to transmit and receive radio frequency signals respectively to and from an external device or system. In further aspects, the chip antenna is configured to increase a radiation efficiency of the antenna arrangement relative to the antenna arrangement devoid of the chip antenna. In some aspects, the chip antenna is configured to increase a radiation efficiency of the antenna arrangement notwithstanding the chip antenna connected to the primary antenna reduces an accepted power of the antenna arrangement. In other aspects, the chip antenna is configured to radiate with the primary antenna to contribute to an electromagnetic field generated by the antenna arrangement. In further aspects, the antenna arrangement is configured such that currents flowing through the primary antenna excite the primary antenna and the chip antenna.

It has been found by the inventors that an antenna arrangement comprising a chip antenna connected to another type of antenna (referred to herein as a primary antenna) outperforms the primary antenna itself. For example, an experimental antenna arrangement comprising a primary antenna in conjunction with a chip antenna demonstrated a substantial increase in radiation efficiency (e.g., 5-6 dB improvement), when compared to a single antenna arrangement (e.g., primary antenna only). An antenna arrangement implemented in accordance with the present disclosure is particularly useful for relatively small hearing devices where a single antenna (due to space constraints) does not provide sufficient performance. For small hearing devices, loading the antenna (e.g., primary antenna) with a chip antenna substantially improves the performance of the antenna. It is understood that the performance gain realized by connecting one or more chip antennas to a primary antenna is not limited to small or custom hearing devices, but such performance gain can be realized in a wide variety of ear-worn electronic devices and other electronic devices.

A chip antenna, such as chip antenna 350, 350*a* shown in FIGS. 3A-3D, is a compact type of antenna. Chip antennas work well in a PCB environment. Chip antennas may offer surface mounted device (SMD) manufacturability in a standard or small form factor. However, chip antennas suffer from a major drawback in that, in order to function properly, a large ground plane is needed to facilitate radiation from the chip antenna. For example, a chip antenna that operates at 2.4 GHz would typically require a ground plane of approximately 40 mm×20 mm, which it is much too large for many hearing device applications (e.g., hearing devices placed at least partially within the ear canal).

An antenna arrangement in accordance with embodiments of the disclosure advantageously eliminates the need for a large ground plane dedicated to the chip antenna. More particularly, the primary antenna of the antenna arrangement serves as a counterpoise for the chip antenna and feeds the chip antenna. Connecting a chip antenna to the primary antenna in accordance with the disclosed embodiments provides for improved antenna performance while maintaining a compact size. This improvement in antenna performance is believed to result from a change in the current flow through the antenna and radiation contribution from the chip antenna. According to various embodiments, a chip antenna is used to load a primary antenna to create more area for the surface current to distribute, increasing the antenna's gain. Loading the primary antenna with the chip antenna serves to enhance the antenna's radiation properties while maintaining a small size.

Chip antennas are different from reactive components, for example, in that chip antennas radiate with the primary antenna to contribute to the electromagnetic field generated by the antenna arrangement. Reactive components, such as inductors and capacitors, are not intended to radiate. For example, the real component of the chip antenna impedance may radiate an electromagnetic field, and the reactive component of the chip antenna impedance may be used to tune, or match with, the antenna structure. In contrast, for other reactive components, the real component of impedance may be lost as heat instead of radiation.

Figure 3A:
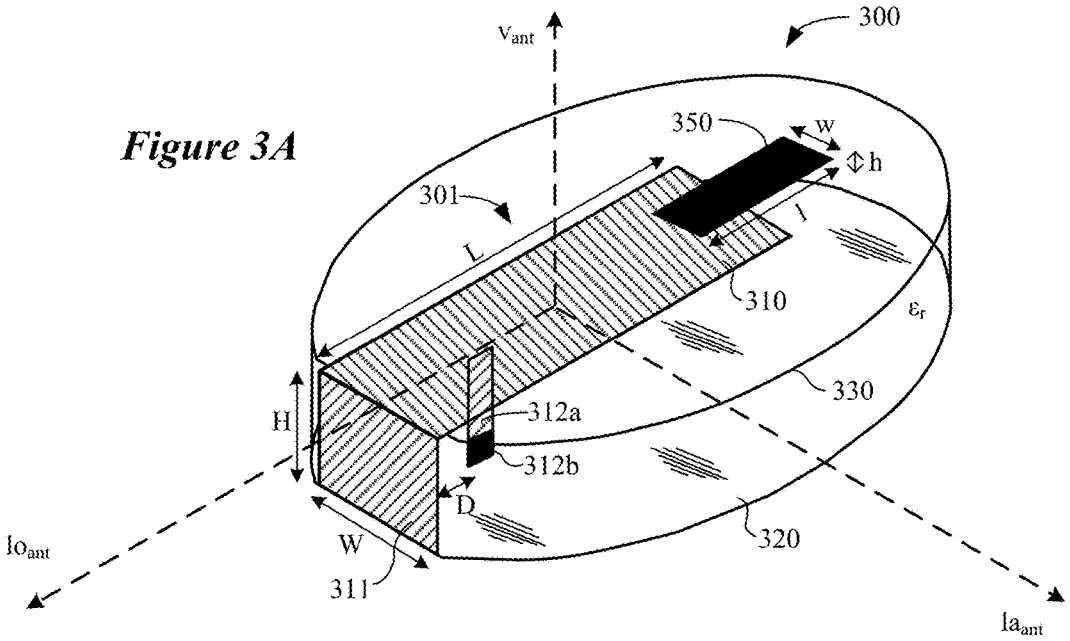
FIGS. 3A and 3B show perspective and cross sectional views, respectively, of an antenna arrangement that can be incorporated into ear-worn electronic devices according to various embodiments, the antenna arrangement comprising a primary antenna and at least one chip antenna.
Figure 3B:
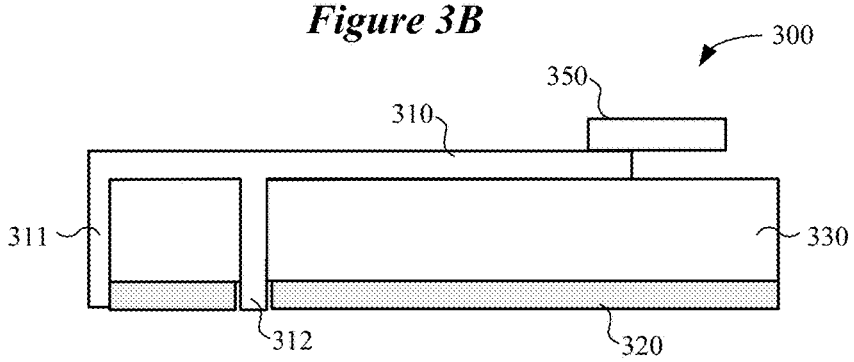

FIGS. 3A and 3B illustrate an antenna arrangement comprising a primary antenna and a chip antenna in accordance with various embodiments. The antenna arrangement 300 shown in FIGS. 3A and 3B can be incorporated in any hearing device, including any of those disclosed herein. The antenna arrangement 300 includes a primary antenna 301 to which a chip antenna 350 is connected. The primary antenna 301 is implemented as a particular type of patch antenna, referred to as a PIFA antenna. Patch antennas, also referred to as rectangular microstrip antennas, are low profile and lightweight making them suitable for use in hearing devices. Although patch antennas may be three dimensional, they can be generally planar comprising a flat plate over a ground plane separated by a dielectric material. Patch antennas can be built on a printed circuit board where the antenna plate and ground plane are separated by the circuit board material which forms the dielectric. The PIFA antenna is a type of patch antenna that is particularly suited for hearing device applications. PIFA antennas are low profile, and have a generally omnidirectional radiation pattern in free space.

FIGS. 3A and 3B show perspective and cross sectional views, respectively, of an antenna arrangement 300 that can be incorporated into hearing devices according to various embodiments. The antenna arrangement 300 includes a PIFA antenna 301 (e.g., primary antenna) to which a chip antenna 350 is connected. For example, the chip antenna 350 can be soldered to the end of the PIFA antenna 301 in a cantilevered arrangement. The PIFA antenna 301 includes a conductive patch 310 and a ground plane 320 that overlaps and is spaced apart from the patch 310. As illustrated in FIG. 3A, the patch 310 extends along a longitudinal axis, $lo_{ant}$, and a lateral axis, $la_{ant}$, that is orthogonal to the axis $lo_{ant}$. The longitudinal and lateral axes define the plane of the patch antenna 310. A vertical axis, $v_{ant}$, is orthogonal to the plane of the patch 310. The conductive patch 310 of the PIFA antenna 301 (e.g., the primary antenna) serves as a counterpoise for the chip antenna 350 and feeds the chip antenna 350. Using the conductive patch 310 of the PIFA antenna 301 as a counterpoise for the chip antenna 350 advantageously eliminates the need for a separate, large ground plane for the chip antenna 350 as discussed above.

The ground plane 320 of the PIFA antenna 301 is separated from the conductive patch 310 by a dielectric 330. A suitable PCB material for the PIFA antenna dielectric 330 has an isotropic dielectric constant in a range of about 12 to about 13. Materials with a dielectric constant in this range or greater are useful to reduce the physical dimensions of the antenna arrangement when compared, for example, to the physical dimensions of an antenna arrangement that uses air as the dielectric. A shorting wall or pin 311 shorts the patch 310 to the ground plane 320. To achieve a desired antenna response, the PIFA antenna 301 may include multiple shorting pins. A wireless transceiver of the hearing device (see items 104 and 230*a,b* in FIGS. 1 and 2) is coupled to the PIFA antenna 301 through a feed arrangement comprising a feed arm 312*a* and a feed point 312*b*.

Figure 3C:
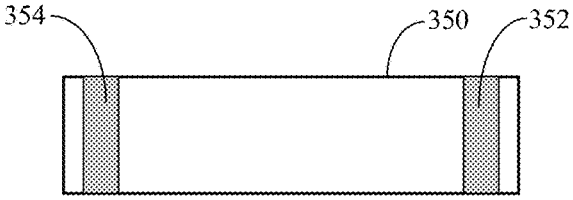
FIG. 3C is a plan view of a chip antenna that can be used in conjunction with a primary antenna in accordance with various embodiments.

FIG. 3C is a plan view of a chip antenna that can be used in conjunction with a primary antenna in accordance with various embodiments. The chip antenna 350 shown in FIG. 3C, includes a mounting pad 352 at one end and a feed pad 354 on the opposing end. In the embodiment shown in FIG. 3A, the feed pad 354 of the chip antenna 350 is connected (e.g., soldered) to the distal open end of the conductive patch 310, with the remaining portion of the chip antenna 350 extending beyond the terminal end of the conductive patch 310 in a cantilevered arrangement.

Figure 3D:
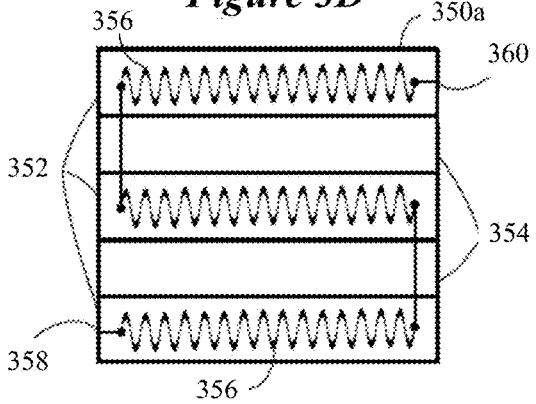
FIG. 3D shows a chip antenna that can be used in conjunction with a primary antenna in accordance with various embodiments.

FIG. 3D is a view of a chip antenna that can be used in conjunction with a primary antenna in accordance with various embodiments. A chip antenna can refer to a device that includes a plurality of layers. In the representative chip antenna 350*a* shown in FIG. 3D, the plurality of layers includes at least a plurality of meandering conductor layers 352 and a plurality of alternating dielectric layers 354. The meandering conductor layers 352 may alternate with the dielectric layers 354. Meandering conductors 356 within each meandering conductor layer 352 may be electrically coupled to one another. The chip antenna 350*a* may include two terminals 358, 360 electrically coupled to opposite ends of the meandering conductors 356. The dielectric material may be selected to tune the chip antenna 350*a* to a particular frequency range, such as a Bluetooth® frequency range from 2.4 up to 2.5 GHz.

According to one embodiment, the antenna arrangement 300 is configured for incorporation in a custom ITC shell, such as a hearing device shell of the type shown in FIGS. 2A and 2B. According to this embodiment, the PIFA antenna 310 has a maximum length L, width W, and height H of 8.826 mm, 3.4798 mm, and 2.5146 mm, respectively. The distance, D, from the feed arm 312*a* to the shorting wall 311 is 1.3 mm. The feed arm 312*a* is shown positioned W/2 mm away from the sides of the patch 310 (e.g., in the center), but can be positioned at non-centered locations. The feed arm 312*a* electrically connects with the patch 310 and the ground plane 320. The feed point 312*b* is a rectangular patch of 0.6 mm×0.6 mm. The substrate material 330 is Rogers TMM 13i ($\varepsilon_r$=12.85-13.2, loss tangent=0.002) available from Rogers Corporation (www.rogerscorp.com), with 0.5 oz. copper on each side. The chip antenna 350 is manufactured by Fractus Antennas (www.fractusantennas.com), with part number FR05-S1-N-0-110, having a length l, width w, and height h of 4.1 mm, 2.0 mm, and 1.0 mm, respectively.

As discussed previously, a chip antenna can be used in conjunction with a variety of different primary antennas to provide for enhanced antenna performance in an ear-worn electronic device in accordance with various embodiments. FIGS. 4-11 illustrate a variety of different primary antennas to which one or more chip antennas are connected in accordance with various embodiments. It is to be understood that the connection locations of the chip antenna(s) on the different primary antennas can differ from those shown in FIGS. 4-11, and the connection locations illustrated in FIG. 4-11 are non-limiting representative locations. The embodiments shown in FIGS. 4-11 are well suited for incorporation in an ear-worn electronic device of the present disclosure.

Figure 4:
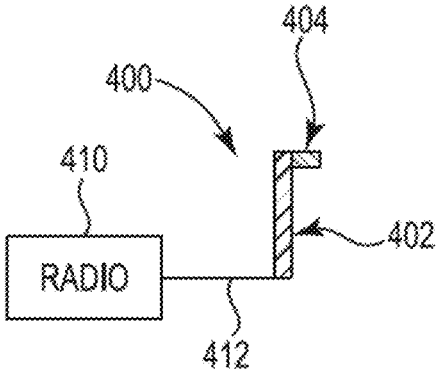
FIG. 4 illustrates an antenna arrangement comprising a primary antenna in the form of a monopole antenna to which at least one chip antenna is connected in accordance with various embodiments.

In the embodiment shown in FIG. 4, an antenna arrangement 400 includes a monopole antenna 402 operably coupled to a radio 410 via a feedline 412. The radio 410 can be configured to operate in the Bluetooth® band, for example. A chip antenna 404 is connected to the monopole antenna 402, such as at a terminal end or other location of the monopole antenna 402. The chip antenna 404 is typically a monopole chip antenna or an inverted-F (IFA)-type chip antenna. More particularly, a feed pad of the chip antenna 404 is electrically connected at or near the distal end of the monopole antenna 402, such that a mounting pad of the chip antenna 404 extends beyond the monopole antenna 402 in a cantilevered arrangement.

Figure 5:
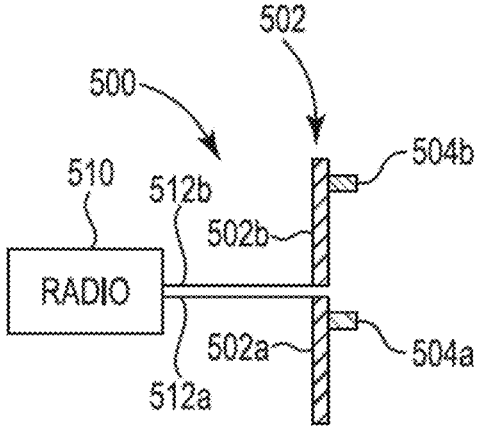
FIG. 5 illustrates an antenna arrangement comprising a primary antenna in the form of a dipole antenna to which at least one chip antenna is connected in accordance with various embodiments.

According to the embodiment shown in FIG. 5, an antenna arrangement 500 includes a dipole antenna 500 operably coupled to a radio 510 via feed lines 512*a*, 512*b*. The radio 510 can be configured to operate in the Bluetooth® band, for example. The dipole antenna 500 includes a first dipole antenna arm 502*a* and a second dipole antenna arm 502*b*. A first chip antenna 504*a* is electrically connected to the first dipole antenna arm 502*a*, and a second chip antenna 504*b* is electrically connected to the second dipole antenna arm 502*b*. The first and second chip antennas 504*a*, 504*b* are typically monopole chip antennas or IFA-type chip antennas. As is shown in FIG. 5, the chip antennas 504*a*, 504*b* can be mounted at different locations on the first and second dipole antenna arms 502*a*, 502*b* (e.g., near the distal end or the proximal end). A feed pad of the chip antennas 504*a*, 504*b* is electrically connected to the first and second dipole antenna arms 502*a*, 502*b*, such that a mounting pad of the chip antennas 504*a*, 504*b* extends beyond the first and second dipole antenna arms 502*a*, 502*b* in a cantilevered arrangement.

Figure 6:
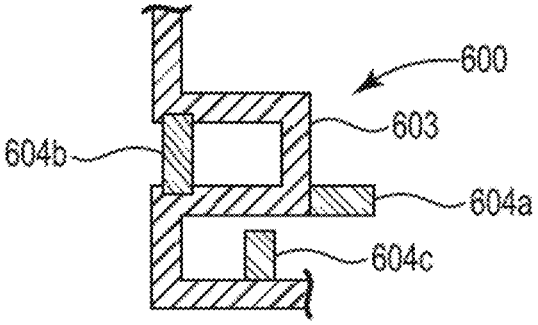
FIG. 6 illustrates a portion of a meandered antenna arm suitable for use in a monopole or dipole antenna configuration to which one or more chip antennas can be connected in accordance with various embodiments.

FIG. 6 illustrates a portion of a meandered antenna arm 600 to which one or more chip antennas can be connected. The meandered antenna arm 600 can be incorporated in a monopole or dipole antenna configuration, such as those shown in FIGS. 4 and 5. FIG. 6 shows possible locations to mount one or more of the chip antennas to the meandered antenna arm 600. For example, chip antenna 604*a* can be electrically connected to the meandered antenna arm 600 at a location distal of a primary antenna bend 603 of the meandered antenna arm 600. Chip antenna 604*c* can be electrically connected at or near a distal end of the meandered antenna arm 600. In the embodiment shown in FIG. 6, chip antennas 604*a* and 604*c* are typically monopole chip antennas or IFA-type chip antennas electrically connected to the meandered antenna arm 600 in a cantilevered arrangement as previously described. The chip antenna 604*b* is connected in parallel between sections of the meandering antenna arm 600. The chip antenna 604*b* is preferably a dual-fed chip antenna, such as a loop-type chip antenna. It is noted that chip antenna 604*b* should be connected to the meandered antenna arm 600 sufficiently away from the primary antenna bend 603 to prevent shorting.

Figure 7:
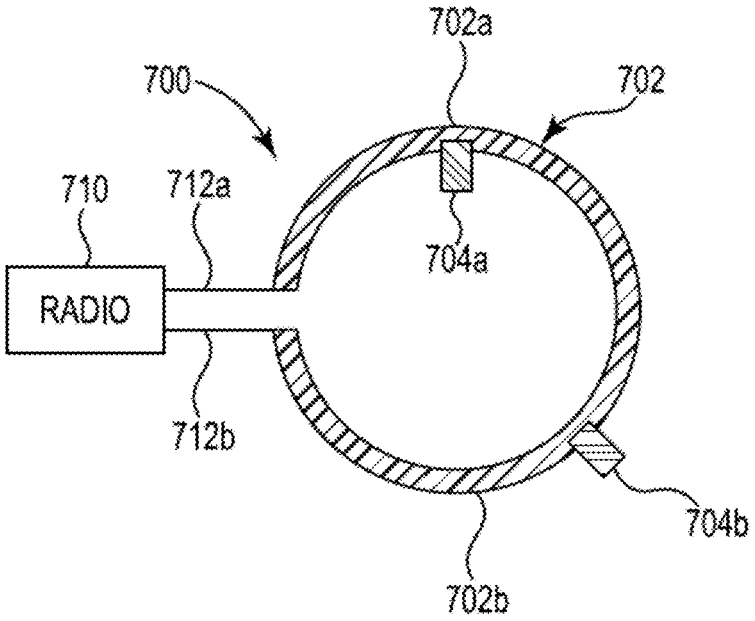
FIG. 7 illustrates an antenna arrangement comprising a primary antenna in the form of a loop antenna to which one or more chip antennas can be connected in accordance with various embodiments.

In the embodiment shown in FIG. 7, an antenna arrangement 700 includes a loop antenna 702 operably coupled to a radio 710 via feed lines 712*a*, 712*b*. The radio 710 can be configured to operate in the Bluetooth® band, for example. The loop antenna 702 includes a first loop antenna section 702*a* and a second loop antenna section 702*b*. Although described as having two antenna section 702*a*, 702*b*, it is understood that the loop antenna 702 can be configured as a continuous loop antenna structure. A first chip antenna 704*a* is mounted to the first loop antenna section 702*a*, and a second chip antenna 704*b* is mounted to the second loop antenna section 702*b*. The first and second chip antennas 704*a*, 704*b* are typically monopole chip antennas or IFA-type chip antennas, with feed pads electrically connected to the first and second loop antenna sections 702*a*, 704*b*, respectively. In FIG. 7, the mounting pad of the first chip antenna 704*a* extends beyond the first loop antenna section 702*a* inwardly towards the interior of the loop antenna 702. The mounting pad of the second chip antenna 704*b* extends beyond the second loop antenna section 702*b* outwardly towards the exterior of the loop antenna 702. It is understood that fewer or more than two chip antennas can be mounted to the loop antenna 702 in the same orientation or different orientations.

Figure 8:
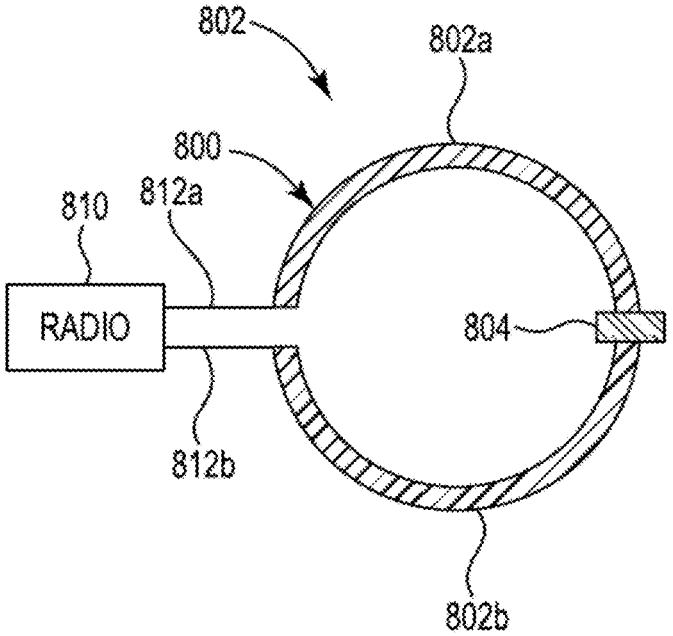
FIG. 8 illustrates an antenna arrangement comprising a primary antenna in the form of a ring antenna, which is a variant of a loop antenna, to which one or more chip antennas can be connected in accordance with various embodiments.

According to the embodiment shown in FIG. 8, an antenna arrangement 800 includes a ring antenna 802 operably coupled to a radio 810 via feed lines 812*a*, 812*b*. The ring antenna 802 shown in FIG. 8 is a variant of a loop antenna. The radio 810 can be configured to operate in the Bluetooth® band, for example. The ring antenna 802 is a two-part antenna structure comprising a first ring section 802*a* and a second ring section 802*b*, with a gap in the conductive material (e.g., copper) between the first and second ring sections 802*a*, 802*b*. A chip antenna 804 extends across the gap in the conductive material (see, e.g., FIG. 10B) and connects the first ring section 802*a* to the second ring section 802*b*. The chip antenna 804 is typically a dual-fed chip antenna, such as a loop-type chip antenna. One feed pad of the chip antenna 804 is electrically connected to the first ring section 802*a*, and a second feed pad of the chip antenna 804 is electrically connected to the second ring section 802*b*.

Figure 9:
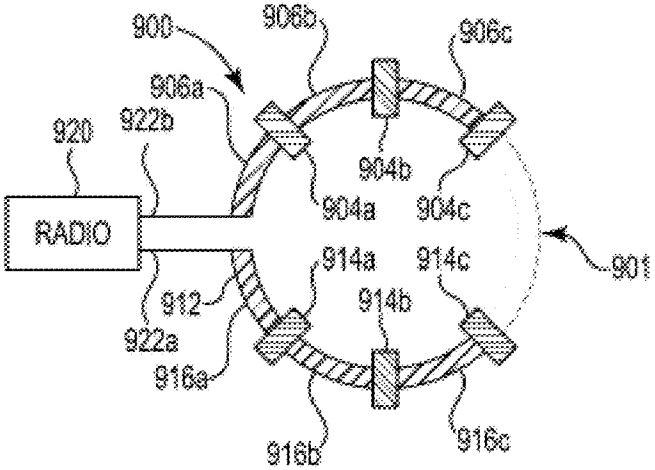
FIG. 9 illustrates an antenna arrangement comprising a primary antenna in the form of a crown antenna, which is a generalization of a ring antenna, to which one or more chip antennas can be connected in accordance with various embodiments.

In the embodiment shown in FIG. 9, an antenna arrangement 900 includes a crown antenna 901 operably coupled to a radio 920 via feed lines 922*a*, 922*b*. The crown antenna 901 is a generalization of the ring antenna illustrated in FIG. 8. The radio 920 can be configured to operate in the Bluetooth® band, for example. The crown antenna 901 can be viewed as an antenna which includes several broken up sections of a loop antenna connected by chip antennas (see, e.g., FIG. 8). For purposes of illustration, the crown antenna 901 is shown to include a first antenna section 902 and a second antenna section 912. However, the first and second antenna sections 902, 912 eventually connect together to form a loop structure, as indicated by the dashed line connecting the ends of the first and second antenna sections 902, 912.

The first antenna section 902 includes a number of chip antennas 904*a*, 904*b*, 904*c* spaced apart from one another by electrically conductive (e.g., copper) sections 906*a*, 906*b*, 906*c*. The chip antennas 904*a*, 904*b*, 904*c* are typically dual-fed chip antennas, such as loop-type chip antennas. Electrically conductive sections 906*a,b,c* are connected to feed pads of chip antennas 904*a,b,c*, respectively, as shown. The second antenna section 912 includes a number of chip antennas 914*a*, 914*b*, 914*c* spaced apart from one another by electrically conductive (e.g., copper) sections 916*a*, 916*b*, 916*c*. The chip antennas 914*a*, 914*b*, 914*c* are typically dual-fed chip antennas, such as loop-type chip antennas. Electrically conductive sections 916*a,b,c* are connected to feed pads of chip antennas 914*a,b,c*, respectively, as shown.

It is understood that a loop antenna to which one or more chip antennas are electrically connected does not have to be circular or have only one turn. As an example, reference is made to FIG. 10 which shows an antenna arrangement 1000 operably coupled to a radio 1010 via feed lines 1012*a*, 1012*b*. The antenna arrangement 1000 includes a loop antenna 1002 configured as a square loop antenna with multiple turns. The loop antenna 1002 includes a first end 1003 electrically connected to feed line 1012*a*, and a second end 1005 electrically connected to feed line 1012*b*. A gap 1006 is provided to prevent shorting between the feed line 1012*b* and regions of the loop antenna 1002 adjacent the feed line 1012*b*. The loop antenna 1002 is formed from an electrically conductive material, such as copper. One or more chip antennas can be electrically connected to the loop antenna 1002 in one or more of a series arrangement, a parallel arrangement, and a cantilevered arrangement.

Figure 10A:
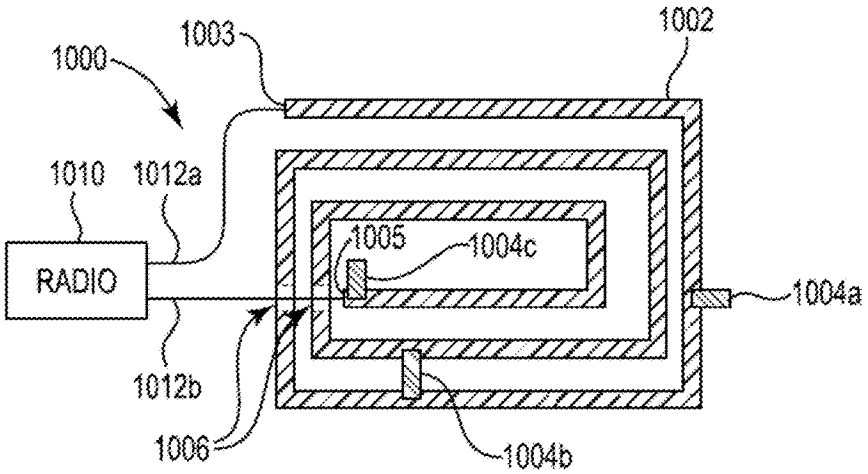
FIG. 10A illustrates an antenna arrangement comprising a primary antenna in the form of a square loop antenna to which one or more chip antennas can be connected in accordance with various embodiments.

For example, and as shown in FIG. 10, chip antenna 1004*a* can be electrically connected to the loop antenna 1002, such that a feed pad is electrically connected to the loop antenna 1002 and a mounting pad extends outwardly beyond the loop antenna 1002 in a cantilevered arrangement. Chip antenna 1004*a* is typically a monopole chip antenna or an IFA-type chip antenna. Chip antenna 1004*b* can be connected in parallel between arms or turns of the loop antenna 1002, such that one feed pad is electrically connected to a first arm and another feed pad is electrically connected to a second arm. Chip antenna 1004*b* is typically a loop-type chip antenna. Chip antenna 1004*c* can be connected at the end 1005 of the loop antenna 1002, such that a feed pad is electrically connected to the loop antenna 1002 and a mounting pad extends outwardly beyond the loop antenna 1002 in a cantilevered arrangement. Chip antenna 1004*c* is typically a monopole chip antenna or an IFA-type chip antenna.

Figure 10B:
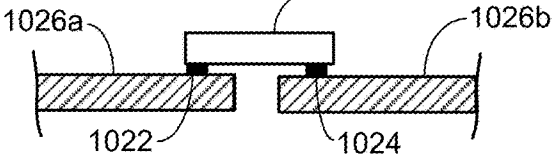
FIG. 10B illustrates a chip antenna connected in a series arrangement to a section of a primary antenna in accordance with various embodiments.

Although three chip antennas 1004*a,b,c* are shown in the embodiment of FIG. 10, fewer or greater than three chip antennas can be mounted to the loop antenna 1002 in one or more of a series arrangement, a parallel arrangement, and a cantilevered arrangement. For purposes of illustration, FIG. 10B shows a chip antenna 1020 connected in a series arrangement across to a discontinuous section (e.g., copper) 1026*a*, 1026*b* of a primary antenna in accordance with various embodiments. The chip antenna 1020 is positioned across a gap between primary antenna sections 1026*a*, 1026*b*, with one pad 1022 electrically connected to section 1026*a* and another pad 1024 electrically connected to section 1026*b*.

Figure 11:
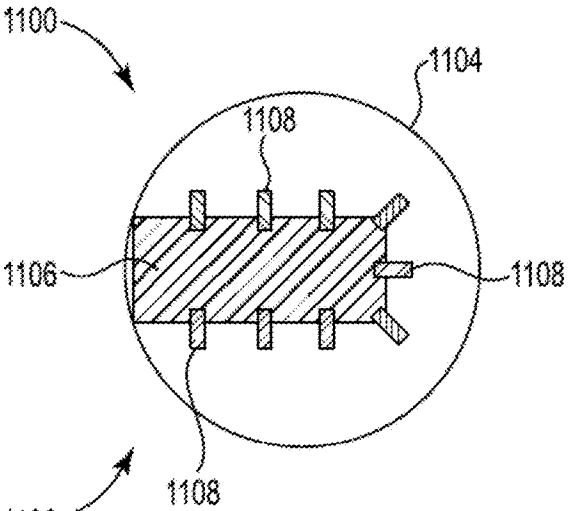
FIG. 11 is a top view of an antenna arrangement comprising a primary antenna in the form of a planar inverted-F antenna (referred to herein as a PIFA antenna) and one or more one chip antennas which can be positioned at different locations on the PIFA antenna in accordance with various embodiments.

FIG. 11 is a top view of an antenna arrangement 1100 comprising a PIFA antenna 1102 and one or more chip antennas 1108 which can be positioned at different locations on the PIFA antenna 1102. The number and location of the one or more chip antennas 1108 can vary from those shown in FIG. 11. The PIFA antenna 1102 can have a configuration the same as or similar to that shown in FIGS. 3A and 3B. In the top view illustrated in FIG. 11, the PIFA antenna 1102 includes a conductive patch 1106 separated from a ground plane 1104 by a dielectric material or substrate, such as that previously described. FIG. 11 shows possible locations where one or more chip antennas 1108 can be electrically connected to the radiating patch 1106. The one or more chip antennas 1108 are typically monopole type chip antennas or IFA-type chip antennas. The one or more chip antennas 1108 can be positioned above any non-metal component or float. As shown, a feed pad of the chip antennas 1108 is electrically connected to the patch 1106, with a mounting pad extending beyond the patch 1106 in a cantilevered arrangement. As was discussed previously, the patch 1106 advantageously serves as a counterpoise for one or more of the chip antennas 1108 (rather than using a separate, large ground plane dedicated for each chip antenna 1108 or ground plane 1104 of the PIFA antenna 1102).

Suitable chip antennas that can be used in conjunction with a primary antenna include monopole chip antennas, loop chip antennas, and inverted-F chip antennas. Suitable monopole chip antennas are available from Fractus Antennas, such as part number FR05-S1-N-0-110, and from Johanson Technology (www.johansontechnology.com), such as part number 2450AT18A100. Suitable monopole chip antennas are also disclosed in U.S. Pat. Nos. 7,148,850 and 7,202,822, which are incorporated herein by reference in their entireties. A suitable loop chip antenna is available from Johanson Technology, such as part number 2450AT01A0100. A suitable IFA chip antenna is available from Johanson Technology, such as part number ANCG12G44SAA145.

A monopole-type ceramic chip antenna, loop-type ceramic chip antenna, and an IFA-ceramic chip antenna represent different chip antennas which, when used in conjunction with a primary antenna, enhance the performance of an antenna arrangement by one or more of improving the overall radiation efficiency of the primary antenna, reducing the needed size of the primary antenna, changing the radiation pattern of the primary antenna, and modifying the input impedance of the primary antenna. It is noted that non-monopole chip antennas (e.g., loop-type and IFA-type), in particular loop-type chip antennas, may have more than two pads. These pads may be able to be connected to the primary antenna, as opposed to needing to be placed off the primary antenna. A loop-type chip antenna is dual-fed and is typically more resistant to detuning. An IFA-type chip antenna is typically a larger chip, but can use a smaller "keep-out" area. Determining which type of chip antenna has the most acceptable tradeoffs for an ear-worn electronic device is important to achieving desired (e.g., optimal) antenna performance.

Some embodiments are directed to an antenna arrangement comprising a primary antenna in the form of a flexible circuit antenna to which one or more chip antennas are electrically connected. In such embodiments, the primary antenna is directly integrated into a circuit flex, such that the primary antenna does not need to be soldered to a circuit that includes the radio and remaining RF components. Examples of primary antennas that can be implemented in the form of a flexible circuit antenna include dipoles, monopoles, dipoles with capacitive-hats, monopoles with capacitive-hats, folded dipoles or monopoles, meandered dipoles or monopoles, loop antennas, Yagi-Udi antennas, log-periodic antennas, inverted-F antennas, planar inverted-F antennas, patch antennas, and spiral antennas.

The size and selection of an antenna arrangement comprising a primary antenna and one or more chip antennas can be dictated by the size of the ear-worn electronic device that incorporates the antenna arrangement. It is understood that the size of an in-ear device is highly variant, as the human ear varies significantly from person to person. Relatively small in-ear devices can be as small as 5 mm in one direction and 10 mm in a perpendicular direction (e.g., an IIC faceplate) and may be only 5-6 mm deep. A relatively large in-ear device may be up to 40 mm across in perpendicular directions (e.g., an ITE faceplate) and up to 30 mm deep. The specific configuration of an antenna arrangement comprising a primary antenna and one or more chip antennas is generally dependent on a number of factors, including the space available in a particular ear-worn electronic device and the particular antenna performance requirements. Due to the performance benefit and small additional size, an antenna arrangement comprising a primary antenna and one or more chip antennas may be incorporated in devices beyond ear-worn electronic devices where device size significantly limits antenna size. Other devices that can incorporate an antenna arrangement of the present disclosure include, but are not limited to, fitness and/or health monitoring watches or other wrist worn objects, e.g., Apple Watch®, Fitbit®, cell phones, smartphones, handheld radios, medical implants, hearing aid accessories, wireless capable helmets (e.g., used in professional football), and wireless headsets/headphones (e.g., virtual reality headsets). Each of these devices is represented by the system block diagram of FIG. 1A or 1B, with the components of FIGS. 1A and 1B varying depending on the particular device implementation.

Figure 12:
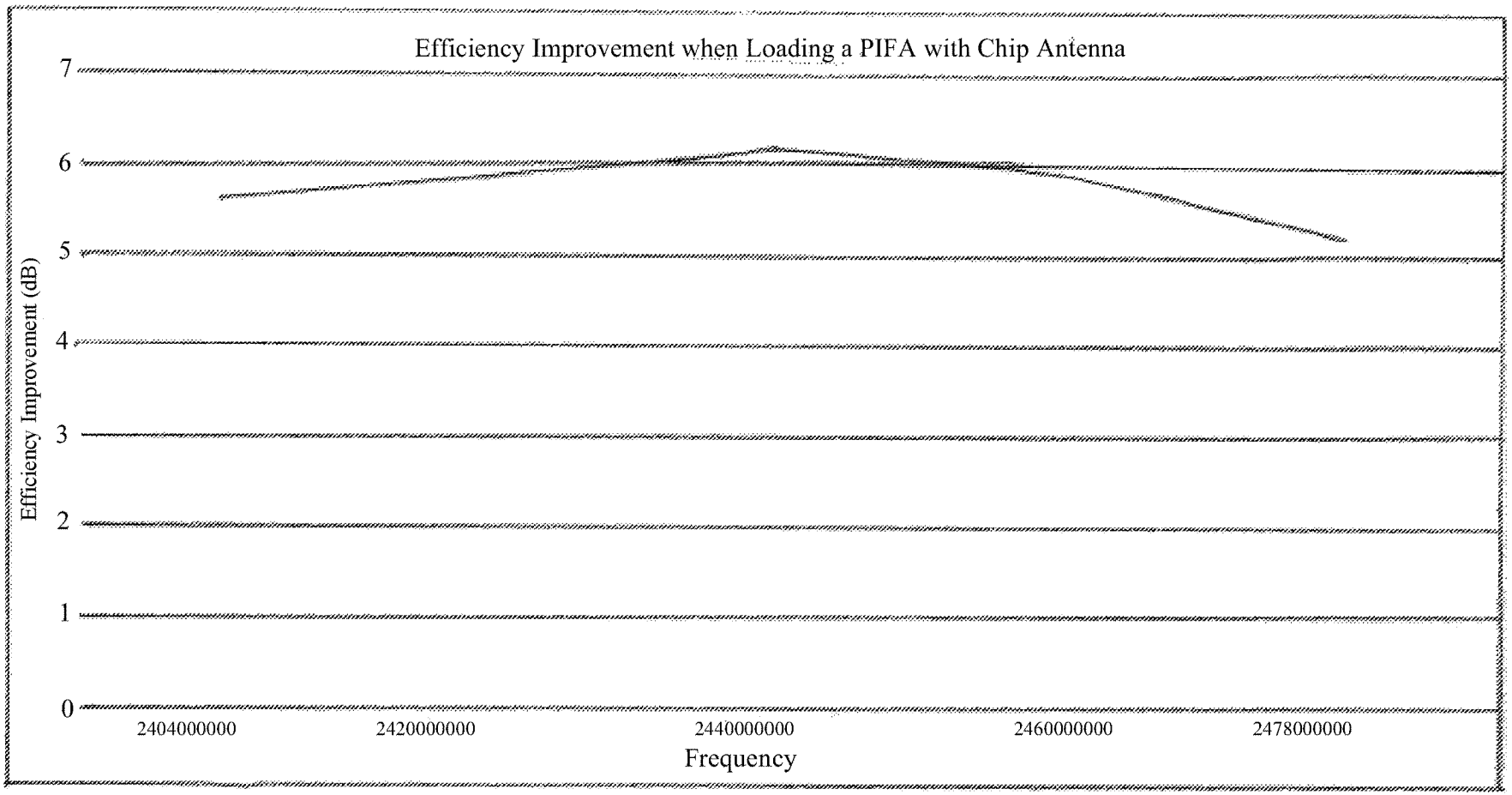
FIG. 12 shows a curve illustrating improvement of radiation efficiency versus frequency for an experimental PIFA antenna with a loaded chip antenna.

Experiments were performed using a PIFA antenna with a chip antenna and a PIFA antenna without a chip antenna. The experimental PIFA antennas had a configuration similar to that shown in FIGS. 3A and 3B, with the dimensions and materials described above (see description following the discussion of FIG. 3D). Both variants of the PIFA (with and without a chip antenna) were placed inside an ITC shell and fed with an SMA cable to measure the return loss, $S_{11}$, and quantify the accepted power difference. The PIFA antennas were positioned in an ear of a phantom head. The improvement in radiation efficiency across a portion of the 2.4 GHz frequency band when loading the PIFA antenna with a chip antenna is shown in FIG. 12. As is shown in FIG. 12, a PIFA antenna loaded with a chip antenna provided for a substantial increase in radiation efficiency (e.g., 5-6 dB improvement) when compared to a PIFA antenna without a chip antenna.

As was discussed previously, the mechanism for improving the efficiency of a PIFA with a chip antenna is believed to involve redistribution of the current. Because the chip antenna is placed at the open end of the experimental PIFA antenna, there is initially very low current (and very low radiation) in this area. However, once the chip antenna is placed at this location, the large surface area of the conducting elements within the chip antenna cause the current to extend out physically closer to the open end of the PIFA antenna. This change in the current pattern is believed to be causing the increase in radiation efficiency of the PIFA antenna loaded with a chip antenna.

This document discloses numerous embodiments, including but not limited to the following:

Item 1 is an ear-worn electronic device adapted to be worn at, by, in or on an ear of a wearer, the device comprising:
- a housing configured to be supported at, by, in or on the wearer's ear;
- a processor disposed in the housing;
- a speaker or a receiver coupled to the processor;
- a radio frequency transceiver disposed in the housing and coupled to the processor; and
- an antenna arrangement disposed in or on the housing and coupled to the transceiver, the antenna arrangement comprising a primary antenna and a chip antenna connected to the primary antenna, wherein the primary antenna serves as a counterpoise for the chip antenna and feeds the chip antenna.

Item 2 is the device of item 1, wherein:
- the chip antenna comprises a first end and an opposing second end;
- the first end is connected to the primary antenna; and
- the second end extends beyond the primary antenna in a cantilevered arrangement.

Item 3 is the device of item 1, wherein the chip antenna comprises a monopole chip antenna.

Item 4 is the device of item 1, wherein the chip antenna comprises a loop chip antenna.

Item 5 is the device of item 1, wherein the chip antenna comprises an inverted-F chip antenna.

Item 6 is the device of item 1, wherein the chip antenna is connected to the primary antenna such that the transceiver is configured to concurrently excite the primary antenna and the chip antenna.

Item 7 is the device of item 1, wherein the primary and chip antennas are configured to cooperate concurrently to transmit and receive radio frequency signals respectively to and from an external device or system.

Item 8 is the device of item 1, wherein the chip antenna is configured to increase a radiation efficiency of the antenna arrangement relative to the antenna arrangement devoid of the chip antenna.

Item 9 is the device of item 1, wherein the chip antenna is configured to radiate with the primary antenna to contribute to an electromagnetic field generated by the antenna arrangement.

Item 10 is the device of item 1, wherein the antenna arrangement is configured such that currents flowing through the primary antenna excite the primary antenna and the chip antenna.

Item 11 is the device of item 1, wherein the primary antenna comprises a flexible circuit antenna.

Item 12 is a hearing device adapted to be worn at an ear of a wearer, the hearing device comprising:
- a housing configured for insertion at least partially within an ear canal of the wearer's ear;
- a processor disposed in the housing;

a speaker or a receiver coupled to the processor;

a radio frequency transceiver disposed in the housing and coupled to the processor; and an antenna arrangement disposed in or on the housing and coupled to the transceiver, the antenna arrangement comprising a planar inverted-F antenna (PIFA antenna) and a chip antenna connected to the PIFA antenna, wherein the PIFA antenna serves as a counterpoise for the chip antenna and feeds the chip antenna.

Item 13 is the device of item 12, wherein the hearing device is configured as an in-the-ear (ITE), in-the-canal (ITC), invisible-in-canal (IIC) or completely-in-the-canal (CIC) device.

Item 14 is the device of item 12, wherein:

the chip antenna comprises a first end and an opposing second end;

the first end is connected to the PIFA antenna; and the second end extends beyond the PIFA antenna in a cantilevered arrangement.

Item 15 is the device of item 12, wherein the chip antenna is connected to the PIFA antenna such that the transceiver is configured to concurrently excite the PIFA antenna and the chip antenna.

Item 16 is the device of item 12, wherein the PIFA and chip antennas are configured to cooperate concurrently to transmit and receive radio frequency signals respectively to and from an external device or system.

Item 17 is the device of item 12, wherein the chip antenna is configured to increase a radiation efficiency of the antenna arrangement relative to the antenna arrangement devoid of the chip antenna.

Item 18 is the device of item 12, wherein the chip antenna is configured to radiate with the PIFA antenna to contribute to an electromagnetic field generated by the antenna arrangement.

Item 19 is the device of item 12, wherein the antenna arrangement is configured such that currents flowing through the PIFA antenna excite the PIFA antenna and the chip antenna.

Item 20 is the device of item 12, wherein a plurality of the chip antennas are connected to the PIFA antenna in a cantilevered arrangement.

Although reference is made herein to the accompanying set of drawings that form part of this disclosure, one of at least ordinary skill in the art will appreciate that various adaptations and modifications of the embodiments described herein are within, or do not depart from, the scope of this disclosure. For example, aspects of the embodiments described herein may be combined in a variety of ways with each other. Therefore, it is to be understood that, within the scope of the appended claims, the claimed invention may be practiced other than as explicitly described herein.

All references and publications cited herein are expressly incorporated herein by reference in their entirety into this disclosure, except to the extent they may directly contradict this disclosure. Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out at least some functionality (for example, a radio chip may be operably coupled to an antenna element to provide a radio frequency electromagnetic signal for wireless communication).

Terms related to orientation, such as "top," "bottom," "side," and "end," are used to describe relative positions of components and are not meant to limit the orientation of the embodiments contemplated. For example, an embodiment described as having a "top" and "bottom" also encompasses embodiments thereof rotated in various directions unless the content clearly dictates otherwise.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise. As used herein, "have," "having," "include," "including," "comprise," "comprising" or the like are used in their open-ended sense, and generally mean "including, but not limited to." It will be understood that "consisting essentially of," "consisting of," and the like are subsumed in "comprising," and the like. The term "and/or" means one or all of the listed elements or a combination of at least two of the listed elements.

The phrases "at least one of," "comprises at least one of," and "one or more of" followed by a list refers to any one of the items in the list and any combination of two or more items in the list.

What is claimed is:

1. An ear-worn electronic device adapted to be worn at, by, in or on an ear of a wearer, the electronic device comprising:

a housing configured to be supported at, by, in or on the ear of the wearer;

a processor disposed in the housing;

a speaker or a receiver coupled to the processor;

a radio frequency transceiver disposed in the housing and coupled to the processor; and an antenna arrangement disposed in or on the housing and coupled to the transceiver, the antenna arrangement comprising a chip antenna and a primary antenna, the primary antenna comprises an inverted-F antenna that includes a ground plane and a conductive patch, wherein:

the chip antenna comprises a first end and an opposing second end, the first end is directly connected to the conductive patch, and the second end extends beyond the primary antenna;

wherein the conductive patch serves as a counterpoise for the chip antenna and feeds the chip antenna.

2. The electronic device of claim 1, wherein:

the second end extends beyond the primary antenna in a cantilevered arrangement.

3. The electronic device of claim 1, wherein the chip antenna comprises a monopole chip antenna.

4. The electronic device of claim 1, wherein the chip antenna comprises a loop chip antenna.

5. The electronic device of claim 1, wherein the inverted-F antenna is a first inverted-F antenna and the chip antenna comprises a second inverted-F chip antenna.

6. The electronic device of claim 1, wherein the chip antenna is connected to the primary antenna such that the transceiver is configured to concurrently excite the primary antenna and the chip antenna.

7. The electronic device of claim 1, wherein the primary antenna and the chip antenna are configured to cooperate concurrently to transmit and receive radio frequency signals respectively to and from an external device or system.

8. The electronic device of claim 1, wherein the chip antenna is configured to increase a radiation efficiency of the antenna arrangement relative to the antenna arrangement devoid of the chip antenna.

9. The electronic device of claim 1, wherein the chip antenna is configured to radiate with the primary antenna to contribute to an electromagnetic field generated by the antenna arrangement.

10. The electronic device of claim 1, wherein the antenna arrangement is configured such that currents flowing through the primary antenna excite the primary antenna and the chip antenna.

11. The electronic device of claim 1, wherein the primary antenna comprises a flexible circuit antenna.

12. The electronic device of claim 1, wherein: the primary antenna inverted-F antenna is a planar inverted-F antenna.

13. The electronic device of claim 1, wherein the hearing device is configured as an in-the-ear (ITE), in-the-canal (ITC), invisible-in-canal (IIC) or completely-in-the-canal (CIC) device.

14. The electronic device of claim 1, wherein the chip antenna is connected to the conductive patch of the inverted-F antenna such that the transceiver is configured to concurrently excite the inverted-F antenna and the chip antenna.

15. The electronic device of claim 1, wherein the antenna arrangement includes a plurality of chip antennas that include the chip antenna, the plurality of chip antennas are connected to the inverted-F antenna in a cantilevered arrangement.

16. The electronic device of claim 1, wherein the housing is configured for insertion at least partially within an ear canal of the wearer's ear.

* * * * *